United States Patent [19]

Laslaz et al.

[11] Patent Number: 4,750,945

[45] Date of Patent: Jun. 14, 1988

[54] CASTINGS MADE FROM ALUMINIUM AND ITS ALLOYS, WHEREOF AT LEAST ONE FACE HAS AT LEAST ONE REGION OF WEAR-RESISTANT ZONES

[75] Inventors: Gérard Laslaz, Laurent du Pont; Serge Terroni, Les Abrets, both of France

[73] Assignee: Cegedur Societe de Transformation de l'Aluminium Pechiney, Paris, France

[21] Appl. No.: 18,460

[22] Filed: Feb. 25, 1987

[30] Foreign Application Priority Data

Feb. 25, 1986 [FR] France ..... 86 03304

[51] Int. Cl.[4] ..... C22F 3/00

[52] U.S. Cl. ..... 148/3; 148/437; 148/903; 148/910

[58] Field of Search ..... 148/4, 900, 901, 903, 148/910, 3, 437, 159; 219/121 LF, 121 LM, 121 LE

[56] References Cited

U.S. PATENT DOCUMENTS 4,157,923 6/1979 Yen et al. ..... 148/159

4,348,263 9/1982 Draper et al. ..... 219/121 LF

OTHER PUBLICATIONS

Research Disclosure no. 177, 17740 *Surface Treatment of Hypereutectic Aluminum-Silicon Castings* 1/79.

*Primary Examiner*—L. Dewayne Rutledge

*Assistant Examiner*—S. Kastler

*Attorney, Agent, or Firm*—Oblon, Fisher, Spivak, McClelland & Maier

[57] ABSTRACT

Castings made from aluminum and its alloys have at least one face including at least one region of wear-resistant zones. These castings are formed by a controlled distribution of zones hardened by local melting effect. The zones, no matter what their length and shape, have a width and depth between 3 and 150 μm and the surface fraction or percentage of the zones for the wear-resistant region is between 5 and 60%.

12 Claims, 3 Drawing Sheets x1000 x25

CASTINGS MADE FROM ALUMINIUM AND ITS ALLOYS, WHEREOF AT LEAST ONE FACE HAS AT LEAST ONE REGION OF WEAR-RESISTANT ZONES

BACKGROUND OF THE INVENTION

1. Field of the Invention

The present invention relates to castings made from aluminium and its alloys, whereof at least one face has at least one region of wear-resistant zones.

2. Discussion of Background

It is known that castings made from aluminium and its alloys, which are subject to friction, must have mechanical characteristics such as wear-resistance and siezure resistance for at least the "active" face thereof, i.e. the face in contact with an opposing part. Usually these characteristics are only required in regions comprising only a portion of the face and in clearly defined zones of said regions. These zones generally receive surface hardening treatments.

Thus, for example, French patent No. 2,371,520 describes a process for treating a given exposed region of an article made from aluminium or its alloys in the presence or absence of an alloying agent by using a laser beam or an electron beam of high energy (at least 10,000 watts/cm$^2$) and a diameter between 250 and 1250 μm, so as to be able to heat the article in a first zone and melt it in a second zone within said first zone. Thus, a fine grain structure is obtained, at least in said second zone, with the aim, inter alia, of improving the wear-resistance while eliminating or reducing the deformations resulting from the treatment. Claim 24 of said patent states that "said beam is displaced along several separate, spaced paths, so as to affect the zones forming spaced regions on the exposed surface of said article."

In the same way, French patent No. 2,367,117 claims "a process for treating a metal bearing surface of a component, characterized in that it consists solely of thermally treating bearing zones in order to modify their metallurgical properties and improve their wear-resistance." According to a special example of this process, the treatment is applied to a pig iron cylinder liner or jacket hardened by cementation and consists of directing onto the latter a laser emitting a beam such that it forms a point with a diameter of 3000 μm.

Japanese patent application No. 59,212,572 teaches a treatment process for hardening the inner surface of an internal combustion engine cylinder by means of a laser in which the surface ratio of the untreated zones to the treated zones is preferably between 10 and 70% and the size of the treated zones is several mm.

Thus, these documents teach that zones suitable for friction bearing surfaces can be obtained on castings or members by thermally treating the surface thereof, so as to locally obtain zones with a width exceeding 250 μm.

Applicants have found that it is possible to obtain localized hardening in the treatment zones, but that said hardening in the case of local melting was on the one hand accompanied by a deformation of the casting, so that remachining was required prior to use and in certain cases said hardening was accompanied by cracking and incipient fatigue cracks due to surface stresses resulting from local overheating caused by the treatment.

SUMMARY OF THE INVENTION

It is for this reason that the Applicants have attempted to develop castings made from aluminium and its alloys, whereof at least one face is treated by a thermal melting effect so as to develop at least one region of wear-resistant zones suitable for friction, but such that only few surface stresses occur, of the type which could lead to cracking or other damage during the use thereof. They can thus be used straight from the treatment process, i.e. without remachining, which is a difficult and time-consuming operation on hardened parts. The resulting thermal and mechanical effects can lead to a modification of the structure of the treated zone and consequently its tribological characteristics.

According to the invention, the castings made from aluminium and its alloys, whereof at least one face is provided on the surface with at least one wear-resistant region constituted by a controlled distribution of zones hardened by a local melting effect are characterized in that said zones, no matter what their length and shape, have a width and depth between 3 and 150 μm and the percentage of the surface area of the wear-resistant region comprising the zones is between 5 and 60%.

Thus, the active faces of the castings according to the invention have on their surfaces and in regions appropriately chosen as a function of the intended use thereof, hardened zones complying with the two following features:

1. A more or less elongated shape, but with very limited width and depth compared with the prior art castings;

2. A fine distribution of said zones, because for each mm$^2$ of surface belonging to a region, they represent 5 to 60% of said surface, i.e. they are spaced from one another by a distance less that 1 mm.

Apart from these features, when said zones intersect the covering or overlap surface fraction thereof should be limited to 50% of the total surface area of the zones for each mm$^2$ of a region.

Under these conditions it has been found that, apart from a significant increase in the wear resistance caused by the presence of hardened zones, the deformatin stresses caused by melting-resolidification of the zones was much less than observed on zones having a greater width and depth or overlapping to a greater extent or intersecting in a more frequent manner.

Moreover, it was found that the dimensional differences between the zones and interzone spaces do not exceed 10 μm, which obviates the need for any remachining of the castings prior to use. In other words, the treatment causes only minor modification to the geometrical profile of the treated casting and only leads to a slight roughness change.

Furthermore, the presence of spaces between the zones significantly improves the suitability of the parts for friction wear resistance by creating on the surface a fine alteration of hardened zones and soft spaces, which is generally very effective with respect to wear-resistance due to adhesion, fatigue or abrasion and also effective in friction resistance because the soft interzone spaces constitute lubricant or wear debris traps.

However, within the above width and depth range of the zones, it has been found that width and depth values between 10 and 100 μm provide the best results.

The invention imposes no shape regularity of the zones and in the case of a zone with a random shape, the width can be defined as being twice the dimension $\frac{1}{4}$ which, in the so-called skeletonization methods used in image analysis, leads to a disappearance of any regular arrangement of the zones on the surface.

The invention is essentially based on the statistical idea of reducing the width and depth of the zones and of separating the same. The distribution and the shape of the zones having a secondary effect compared with the width-depth effect and the surface fraction thereof.

However, for reasons of ease of forming the zones on the surfaces of the castings, the invention also includes zones regularly arranged on the surface of the castings in the form of periodic or quasi-periodic networks of bands or strips, whose width and depth are between 3 and 150 μm.

Thus, the zones can be arranged in the form of continuous bands separated from one another by a distance between 20 and 1000 μm, said bands either having a random direction, or having at least one network of parallel bands. However, these zones can also be arranged in the form of discontinuous bands separated along their length, and so one from the other, by a distance between 20 and 1000 μm. As stated above, these bands either have a random direction or there is at least one network of parallel bands.

The invention more particularly applies to any aluminium alloy, whereof the tribological properties are liable to be improved by a surface melting treatment. It also applies to all castings, where zones are formed by an aluminium alloy melted with an addition compound or element, such that the tribological properties of said alloy are improved. For example, said addition element can be iron or nickel.

The zones according to the invention can be obtained by any process making it possible to locally modify, by melting-resolidification, the nature or structure of the surface of the casting over a limited depth and width, so as to give better friction wear characteristics thereto due to a thermal and/or chemical effect.

In particular, it is possible to use high energy radiation, such as electron beams and laser rays appropriately focused so as to produce melting zones having a width and depth less than 150 μm.

It is easily possible to obtain bands which are axial, circular, helical or any other shape by controlling the relative displacement of the casting and/or the beam by means of a microprocessor.

For example, with a conventional argon laser beam with a power of 18 watts sufficiently focused ot give a power density exceeding $1.10^6$ watts/cm$^2$, it has proved possible to obtain on the surface of an aluminium-silicon alloy casting a network of square meshes formed from bands having a width of 30 μm and separated from one another by a distance of 100 μm by exposing the castings to the action of the beam for less that $1.10^{-1}$ second and moving the beam with respect to the casting, so as to make it describe a series of parallel paths in two perpendicular directions. However, it is also possible to use energy sources able to emit a large number of beams, so that the network can be obtained in a more practical manner.

Thus it has proved possible to obtain a group of small treated zones (width<150 μm) separated from one another and formed in a surface constituted by a hard material inserted in a softer die. The thus treated casting only had minor deformations of the surface profile, thereby obviating the need for machining. The application thereof to an aluminium alloy engine liner or jacket led to no deterioration in material characteristics, as a result of the release of stresses, and the tribological behavior thereof on contact with the piston was better than that of liners or jackets whose entire surface had been treated with energy beams producing zones with a width of 3000 μm.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
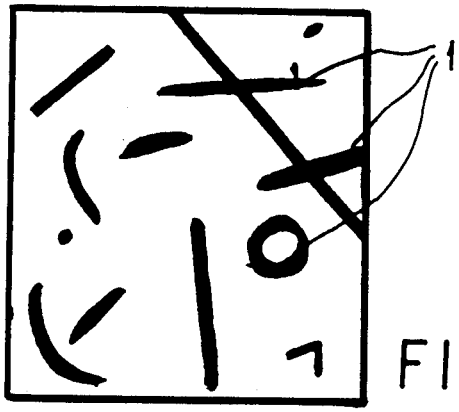
FIGS. 1, 2 and 3 show different arrangements of the zones produced according to the invention on a region of an active base of a casting.
Figure 2:
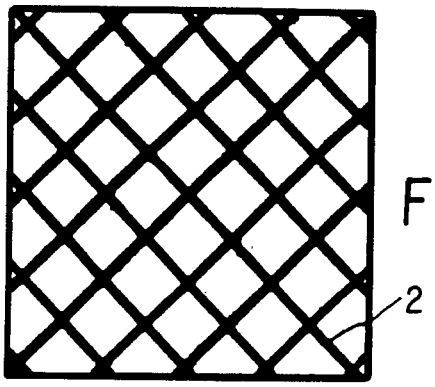

FIG. 1 shows zones (1) of random shape and width distributed in a random manner, but which have in each case a width between 10 and 100 μm and a percentage surface fraction of between 5 and 60% of the area of the wear-resistant surface of the casting. FIG. 2 shows zones regularly arranged in accordance with a square mesh network constituted by bands (2) having a width of 40 μm and spaced from one another by 360 μm.

Figure 3:
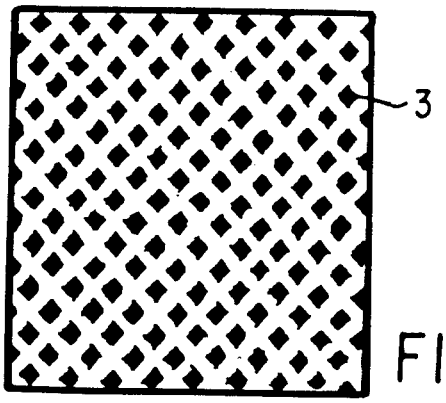

FIG. 3 shows punctiform zones (3) with a size of 50 μm and spaced from one another by 100 μm.

Figure 4:
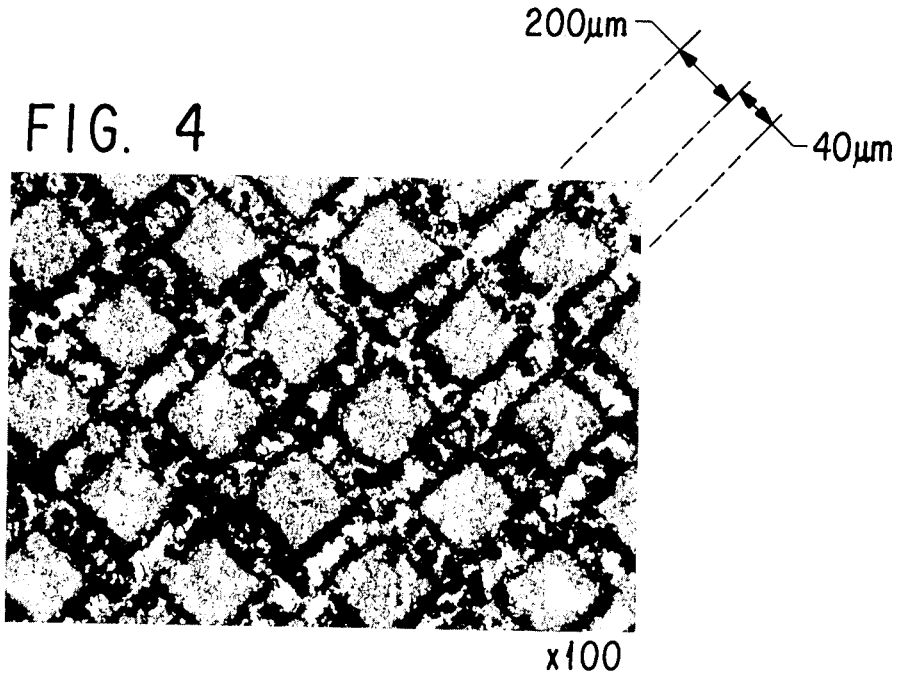
FIG. 4 is a microphotograph of a portion of the region of a casting according to the invention.

FIG. 4 is a microphotograph, with a magnification of 100, of zones distributed in accordance with bands with a width of 40 μm, spaced by 200 μm and intersecting ar right angles, the zones being obtained on an aluminium alloy casting of type A-S17U4G (17% silicon, 4% copper, <1% magnesium and the remainder aluminium).

Figure 5:
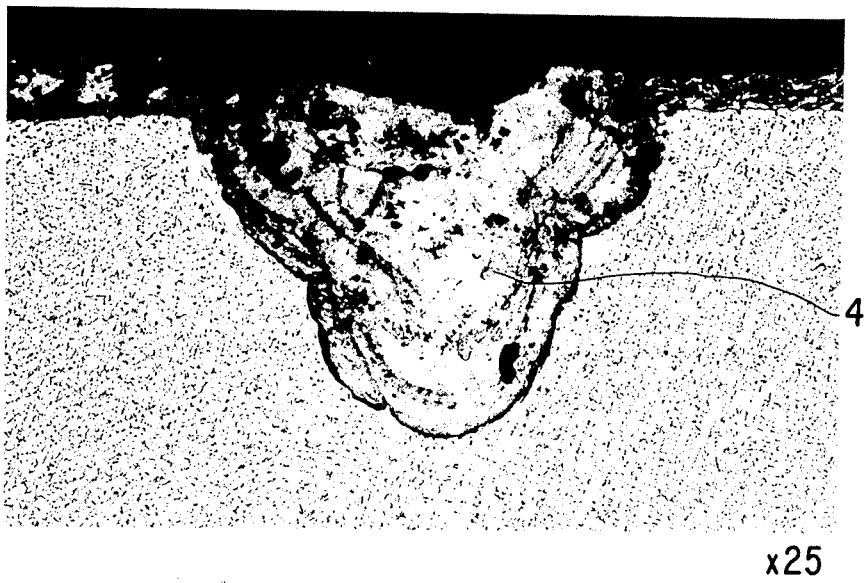
FIGS. 5 and 7 are microsections of a casting according to the prior art.
Figure 6:
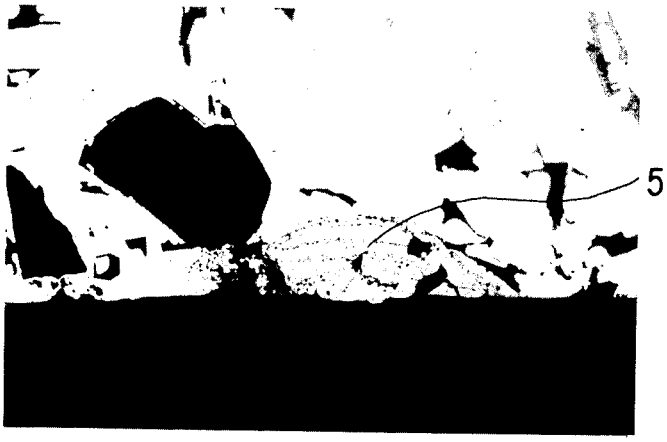
FIG. 6 is a microsection of a casting according to the invention.
Figure 7:
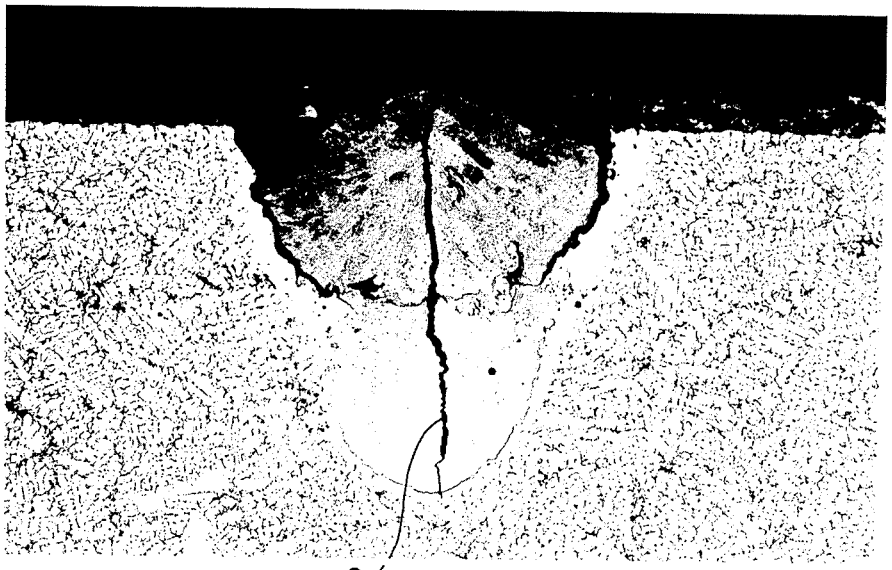

FIGS. 5, 6 and 7 will be referred to during the description of the following example.

APPLICATION EXAMPLE

Castings of A-S5U3 (i.e. containing by weight 5% silicon, 3% copper and the remainder aluminium and impurities) and A-S17U4G (17% Si, 4% Cu, <1% Mg) all produced in the same way, were subdivided into two batches 1 and 2, both batches having both alloy types.

Batch 1 underwent a laser treatment to obtain zones in accordance with the prior art and batch 2 underwent another laser treatment to obtain zones according to the invention. The conditions of these treatments are as follows:

| | Batch 1 | Batch 2 |
|---|---|---|
| Laser beam | $CO_2$ | Ar |
| Power (watts) | 2500 | 18 |
| Beam width (μm) | 1000 | 20 |
| Power density (watts/cm$^2$) | $2.5 \times 10^6$ | $7 \times 10^6$ |
| Treatment duration (sec) | 6/100 | 1/40 |
| Treated zone width (μm) | ≃3000 | ≃40 |
| Treated zone depth (μm) | ≃2600 | ≃20 |

The following findings were obtained:

From the relief of FIG. 5, showing in section and a magnification of 25 a batch 1 casting having a zone (4), there is seen a raised macroscopic relief extending over the entire width of the zone and whose amplitude reaches 100 μm, so that remachining of the casting is necessary. The casting of batch 2 (FIG. 6) shows in section, and with a magnification of 1000, a zone (5) having no macroscopic relief but only the microroughness is slightly affected. Thus the batch 2 castings require no remachining.

In FIGS. 5 and 6, it is also possible to see a radical structural change at the zones, permitting a precise location of the zones and the measurement of their dimensions. On both batches, a Vickers hardness exceeding 200 was measured in the zones, whereas it was 80 between the zones.

Therefore, the castings according to the invention, and which consequently have zones of limited width and depth, have a degree of deformation of the surface profile making it unnecessary to machine them.

Other castings of the same type were previously coated with an iron film by electrolysis in a quantity such that, after melting, it was possible to produce on the surface a 15% iron alloy. These castings were also distributed into two batches, which underwent the same treatments as those described hereinbefore, with the exception of the arrangement of the treated zones.

Thus, the surfaces of the castings of batch 1 (prior art) were treated along unidirectional parallel bands, which overlapped (batch 1A), or which did not overlap (batch 1B), with the distance between the bands being 2000 μm, whereas the surfaces of the batch 2 castings were treated along a network of parallel bands intersecting at right angles and spaced from one another by 200 μm.

Micrographic examination of the surfaces revealed that in certain cases the treated zones of batches 1A and 1B suffered from cracking (6) (FIG. 7), whereas those of batch 2 were uncracked.

In another series of tests, the iron was replaced by galvanic deposition of nickel, so as to produce on the surface after melting a 10% nickel alloy, and the castings of both batches underwent friction—wear measurements using the CAMERON-PLINT tribometer. This tribometer is constituted by a ferrochromium segment, which bears on the surface to be checked and which performs an alternating movement, so as to approximately simulate the friction occurring between the segments inserted in the piston and jacket of an internal combustion engine.

In these tests, the bearing load was 100 N, the casting temperature 100° C., the frequency of the movement 12 Hz and the test duration 30 minutes. The surface was previously lubricated with a Neutral 150 oil. The castings of batch 1 were subject to rapid deterioration (detachment of large debris > 1 μm from the treated surface) and this also applied to the ferrochromium segment. However, in the case of the castings in batch 2, there was no visible deterioration or measurable weight loss.

The present invention can be used in the production of castings subject to friction, such as e.g. mechanical parts (jackets of engines and pistons, valve seats, brake disks and drums, notched driving pulleys, die plates, gears, dies, drive shaft bearings, ball bearings, etc.) and electric contact parts where there is a combination of friction and the passage of electric current (connectors, sliding contacts, electric motor commutators, etc.).

Obviously, numerous (additional) modifications and variations of the presnt invention are possible in light of the above teachings. It is therefore to be understood that within the scope of the appended claims, the invention may be practiced otherwise than as specifically described herein.

What is claimed as new and desired to be secured by letters patent of the United States is:

1. A casting made of a material taken from the group consisting of aluminium and aluminium alloy, said casting having at least one surface including at least one wear-resistant region comprising a controlled distribution of zones hardened by localized melting and resolidification, wherein said zones have a width and a depth of between 3 and 150 μm and wherein a percentage of the surface area of said wear-resistant region comprising said zones is between 5 and 60%.

2. The casting according to claim 1 wherein said zones intersect, and an overlapping surface fraction of said zones is less than 50% of the total surface of said zones.

3. The casting according to claim 1 wherein said zones have a depth and width between 10 and 100 μm.

4. The casting according to claim 1 wherein said zones are arranged in the form of continuous bands extending in random directions and separated from one another by a distance between 20 and 1000 μm.

5. The casting according to claim 4 wherein said zones are arranged in the form of at least one network of parallel bands.

6. The casting according to claim 1 wherein said zones are arranged in the form of discontinuous bands having a random direction and separated along their lengths and from one another by a distance between 20 and 1000 μm.

7. The casting according to claim 1 wherein said zones are arranged in the form of at least one network of parallel bands.

8. The casting according to claim 1 wherein said casting is formed from an alloy whose tribological properties can be improved by a surface melting treatment.

9. The casting according to claim 1 wherein said zones are formed from a base metal alloy plus an addition element or compound such that a resulting alloy has better tribological properties than said base metal alloy.

10. The casting according to claim 9 wherein said addition element is one from the group consisting of iron and nickel.

11. A process of making a casting formed of a material taken from the group consisting of aluminium and aluminium alloy, said casting having at least one surface including at least one wear-resistant region, said process comprising the steps of:

applying focused laser radiation to said wear-resistant region to produce melting zones, controlling at least one of said casting and said laser radiation such that said melting zones have a width and a depth of less than 150 μm; and permitting said melting zones to resolidify to form hardened zones.

12. The process of claim 11 wherein said controlling step includes the step of controlling said at least one of said casting and said laser radiation such that a percentage of the surface area of said wear-resistant region comprising said zones is between 5 and 60%.

* * * * *